United States Patent [19]

Okamoto

[11] 4,381,335

[45] Apr. 26, 1983

[54] MULTI-COMPONENT COMPOSITE FILAMENT

[75] Inventor: Miyoshi Okamoto, Takatsukishi, Japan

[73] Assignee: Toray Industries, Inc., Tokyo, Japan

[21] Appl. No.: 249,846

[22] Filed: Apr. 1, 1981

Related U.S. Application Data

[63] Continuation of Ser. No. 91,161, Nov. 5, 1979, abandoned.

[51] Int. Cl.[3] ..... D02G 3/00

[52] U.S. Cl. ..... 428/373; 264/171; 428/224; 428/369; 428/370; 428/374; 428/397

[58] Field of Search ..... 428/373, 374, 397, 369, 428/370, 224; 264/171, 147

[56] References Cited

U.S. PATENT DOCUMENTS

| | | | |
|---|---|---|---|
| 2,932,079 | 4/1960 | Dietzsch et al. | 428/374 |
| 3,718,534 | 2/1973 | Okamoto et al. | 428/374 |
| 4,073,988 | 2/1978 | Nishida et al. | 428/374 |

FOREIGN PATENT DOCUMENTS

| | | | |
|---|---|---|---|
| 46-3815 | 1/1971 | Japan | 428/374 |
| 46-27776 | 8/1971 | Japan | 264/171 |
| 47-35614 | 9/1972 | Japan | 264/171 |
| 47-39726 | 10/1972 | Japan | 264/171 |

*Primary Examiner*—Lorraine T. Kendell
*Attorney, Agent, or Firm*—Austin R. Miller

[57] ABSTRACT

A composite filament having an "islands-in-sea" type cross-sectional configuration having at least two kinds of islands, wherein the two islands are different in coefficient of contraction by at least 5%, or wherein one of the island components comprises a bimetal-type or eccentric-type composite filament. These island components are relatively well distributed throughout the sea component and the sum of the weight of the island components is greater than the weight of the sea component. Said composite filament may be made into a fabric as a filament of an ordinary denier. It is also possible to obtain a superfine fiber product being bulky or having an improved feel by superfining and heat-treating said filament thereafter.

10 Claims, 39 Drawing Figures

MULTI-COMPONENT COMPOSITE FILAMENT

This is a continuation, of application Ser. No. 091,161, filed Nov. 5, 1979, and now abandoned.

The present invention relates to a multi-component composite filament. Binary composite filaments are well known. The most representative kind of these filaments is made by removing one component from two components or separating one component from the other to form a bundle of superfine filaments.

However, the so obtained bundle of superfine filaments and fabrics made from such filaments frequently has the following drawbacks:

(1) Because they are superfine filaments, they are extremely low in rigidity and lacking in bulkiness. This result occurs in both of the aforementioned methods of manufacture.

(2) Napped fabrics, for example, velvet-like knitted or woven fabrics, raised fabrics, buffed fabrics of non-woven velveteen, corduroy, seal, fur and electrodeposited fabrics have been commonly lacking in natural tone and high quality feeling. In other words, they have been excessively uniform and monotonous.

(3) It has been difficult to produce fabric having a crisp feel, with crepe, tenseness, and stretch recovery having little tendency for individual threads to be loosened, further having variety in color tone, and resembling silk.

On the other hand, I, the present inventor, have developed a three-component composite filament, from which one component is removed, thus producing a composite filament consisting of the other two components. I have also invented a fabric having a peculiar feel which is made therefrom. However, in the case of a bundle of superfine filaments which is 100% composed of composite filaments, the characteristics of the bundle are frequently less beneficial than might be expected based on the crimp capacity of the filaments.

As a result of conducting various examinations, I have found a novel composite filament which has drastically improved characteristics as compared to these drawbacks. In addition, this novel composite filament may be seen to have various other novel characteristics which have not been seen in prior composite filaments.

The essence of this novel composite filament is as follows:

(1) A multi-component composite filament having an "islands-in-sea" type cross-sectional configuration in which at least two different kinds of filamentary island components are dispersed independently without maldistribution of any one component to one side in a sea component (i.e., the different island components are not unevenly distributed such that the weight of any one component predominates on any one side of the filament), wherein the respective components have different coefficients of free contraction wherein difference in coefficient of free contraction as between the two kinds of island components is at least 5%, and wherein the sum of the weights of these island components exceeds the weight of the sea component.

(2) A multi-component composite filament having an "islands-in-sea" type cross-sectional configuration in which at least two different kinds of island components are dispersed independently without maldistribution of any one component to one side in a sea component, wherein one individual kind of island components consists of an island of the usual type and the other individual kind of island component comprises a binary bicomponent type or eccentric-type composite superfine filament and wherein the sum of the weights of these island components exceeds the weight of the sea component.

Hereinbelow, a detailed description will be made with reference to the present invention, reference being made to the drawings, in which:

BRIEF DESCRIPTION OF THE DRAWINGS

FIG. 1 is a schematic view of a bundle of superfine filaments, illustrative of the present invention, as well as a conventional bundle of superfine filaments. Selected filaments of such a bundle, enlarged, are also shown in FIG. 2(*a*). However, when this bundle is subjected to contraction, in accordance with the present invention, it appears as shown in FIG. 2(*b*), wherein a component is contracted and is crimped, while other filaments which are less contracted are properly interposed among the contracted filaments and the resulting filament bundle becomes puffy. Accordingly, when island components A and B are maldistributed in component C and components A and B are not mixed at least somewhat symmetrically, there is little uniformity of puffiness. This is not preferred. It is preferable that these island components A and B should be well mixed and mutually interposed. In this sense, it is important that the multi-component composite filament of the present invention be convertible to a bundle of puffy superfine filaments.

The composite filament according to the present invention is convertible to a superfine multifilament bundle, wherein crimped or slack superfine filaments and straight superfine filaments coexist without maldistribution, by dividing and contracting treatments to be described in detail hereinafter. The superfine filament bundles of the present invention may be roughly divided into three types.

A first type has at least two different kinds of island components A and B, both the island components A and B being independently dispersed in another component (sea component) C. Island components A and B may have various types of cross-sectional areas, examples of which are shown in FIGS. 3–10.

Figure 3:
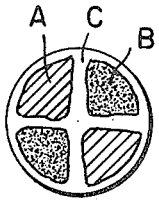
FIGS. 3–36 are cross-sectional views of composite filaments according to the present invention.

Island components A and B in FIG. 3 are shown to be dispersed in a regularly interposed pattern in sea component C. When the deniers of these island components are within the range of 2–0.6 d, this filament is very useful as a material for producing silk-like and wool-like fabrics in a manner to be described in detail hereinafter. This filament is also effective as a starting material for making plush, velveteen and corduroy.

Figure 4:
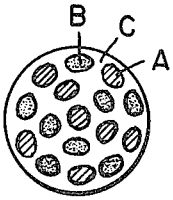

FIG. 4 is an example wherein two island components A and B are in a random mixed arrangement. The components A and B are mutually, but randomly interposed.

Figure 5:
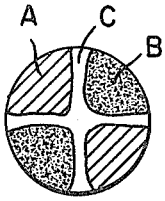

In FIG. 5, island components A and B are disposed in a manner similar to the island components A and B in FIG. 3. However a composite filament of this type may be called a peeling type or an exposed surface type because the outer surfaces of island components A and B are exposed. When the island components A and B are separated and become independent, the sea component C remains as a fiber, requiring separate consideration.

Figure 6:
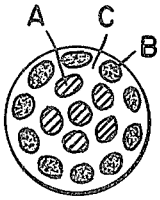

FIG. 6 shows an example wherein one of the components A or B, the inner grouping of island components A in the example illustrated, is surrounded by the outer grouping of the other island component B. In this case, too, one component is interposed with respect to the other.

Figure 7:
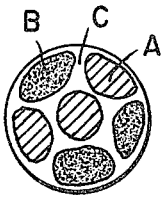

FIG. 7 shows another example in which the grouping of island components A extends through the grouping of island components B.

Figure 8:
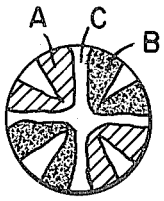

FIG. 8 is a peeling type composite filament, with both components A and B having exposed surfaces. In this case, after mechanically peeling components A and B from component C, it is possible to further halve the components A and B.

Figure 9:
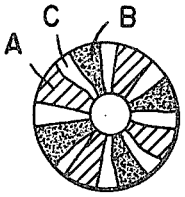

FIG. 9 is a hollow type composite filament wherein four components A and four components B are provided and wherein it is possible to peel away the interposing component C, or otherwise to remove the component C.

Figure 10:
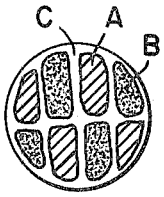

FIG. 10 is an example of another form of composite filament wherein island components A and B are differently disposed. In this example, a denier mix is accompanied by a mixing of heterogeneous cross sections. When a wool-like composite filament is to be made, a filament of the type shown in FIG. 10 is especially preferable as a starting material. In this case, a multilobal cross section (at least trilobal) is especially preferable.

In the cases illustrated in FIGS. 3–10, it is necessary that there be a difference in coefficient of contraction between the two island components A and B. The difference should be at least 3%, but preferably is at least 5%. This is especially true in the case of filaments in which the component C is peeled away but is allowed to remain in the admixture with the island components A and B. The difference in coefficient of contraction as referred to herein, eans a difference in the coefficient of free contraction without hinderance. Ordinarily, the coefficient of contraction of a filament in a knitted or woven fabric is often lower than the coefficient of free contraction due to restrictions in the fabric. Even though the difference the respective coefficients is small, it still greatly affects fabric bulkiness. Accordingly, the respective coefficients of contraction are measured after separating or peeling the island components A and B from the sea component C by use of a solvent or decomposition agent which has the effect upon the island components A and B. Contraction may be measured by any one of boiling water contraction, solvent contraction and high-temperature heating contraction. As stated, the difference of coefficient of contraction should be at least 3% when tested by any one of these contraction test methods. Typically, the boiling water contraction method and the high temperature dry contraction method are commonly used. In this specification, the contraction values referred to are often based on these test methods.

Thus, a filament whose coefficient of contraction is small slackens relative to a filament whose coefficient of contraction is large, thus making a bulky and puffy bundle of superfine filaments.

This puffiness may be brought about with the filament in the form of a yarn, but it is more effective with the filament in the form of a fabric.

The relation between disposition of components A and B in the cross-sectional area of a composite filament and the difference in coefficient of contraction is important.

Figure 11:
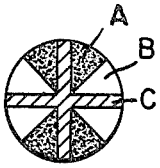
Figure 12:
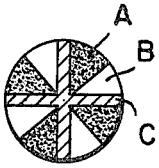
Figure 13:
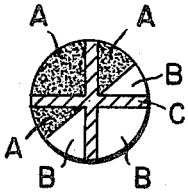
Figure 14:
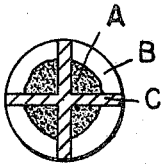
Figure 15:
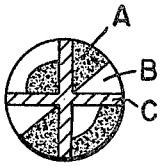
Figure 16:
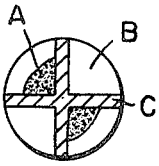
Figure 17:
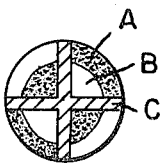
Figure 18:
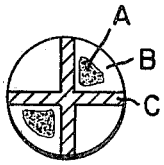
Figure 19:
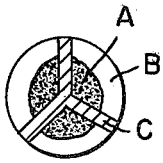
Figure 20:
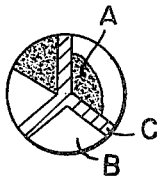
Figure 21:
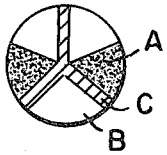
Figure 22:
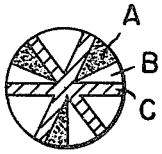
Figure 23:
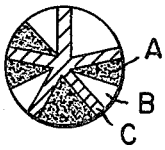
Figure 24:
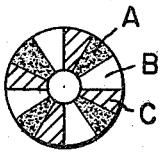
Figure 25:
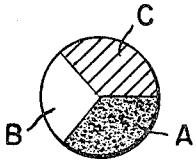
Figure 26:
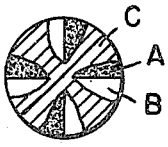

A second type of filament in accordance with the present invention is shown in FIGS. 11–26, in which island components A and B are separated by sea component C. In this type of filament, the mixture of composite filaments may consist of island components A and B having a bicomponent-type or eccentric-type cross-sectional configuration, which are intended to be removed and separated from component filament C, as a result. Also, the resultant filament may consist of a single component filament of the component A and/or B in admixture with the remaining components of the original filament bundle. For instance, in the case of FIG. 11, a mixture is shown consisting of a bicomponent-type composite superfine filament consisting of adhering components A and B, and a superfine filament of component C in admixture therewith arranged in the shape of a cross. In the case of, for example, FIG. 13, the composite filament comprises a bundle of superfine filaments consisting of a bicomponent-type composite superfine filament consisting of adhering components A and B in combination with a cross-shaped superfine filament of component C, as well as other superfine filaments consisting of the component A alone and the component B alone. When considered similarly, it may be easily understood what sorts of bundles of superfine filaments are shown in each of the other figures. Namely, throughout all the examples of FIGS. 11–26, combinations are shown each consisting of a bicomponent-type or eccentric-type composite filament and superfine filaments consisting of a single component.

A third type of composite filament of the present invention is that in which, after component C has been dissolved and removed, there remains a bundle of superfine filaments consisting of a combination of bicomponent-type or eccentric-type composite filaments consisting of components A and B, combined with superfine filaments of a single component consisting of the component A or B or both. This combination of (a) bicomponent or eccentric and (b) single component filaments is shown, for example, in FIGS. 13, 16, 18, 20, 21 and 27–36. FIGS. 27–36 particularly show examples of filaments in each of which components A and B are surrounded by component C.

Figure 37:
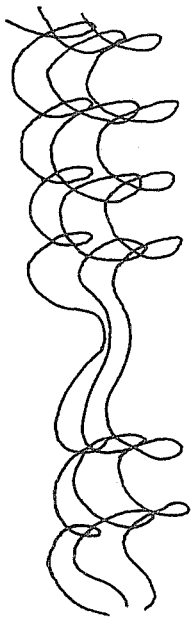
FIG. 37 is a schematic view showing overlap of crimps (at the time of free crimping) of a bundle of conventional superfine filaments.

In each of these second and third types of filaments of the present invention, utilizing bicomponent filaments, components A and B that are adherent to each other, yet have different coefficients of contraction, are selected as the island components. Only when these conditions are met are very excellent effects to be mentioned later, obtained. When all of the island components are composite filaments having roughly the same coefficient of contraction and the sea component is removed, followed by treatment with heat and solvents, only crimp as shown in FIG. 37 will be produced. In such crimp, the loops of the crimp often overlap and the feel is different and it is difficult to produce enough bulkiness in many cases.

Figure 1:
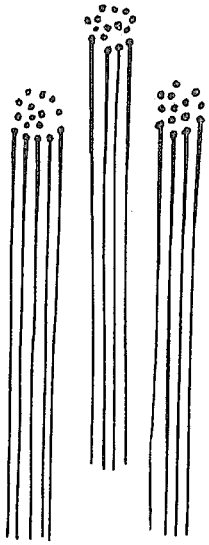
FIG. 1 is a schematic view showing a bundle of superfine filaments obtained from a conventional composite filament.
Figure 2A:
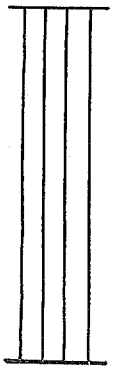
FIGS. 2*a* and 2*b* are explanatory views showing the principle by which superfine filaments become bulky.
Figure 2B:
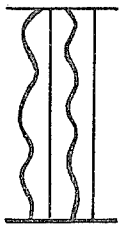
Figure 38:
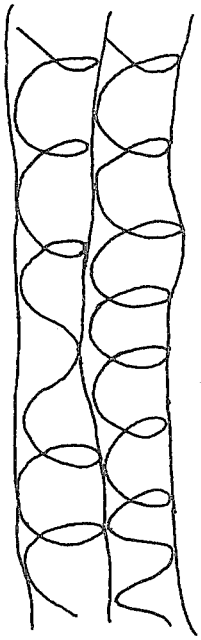
FIG. 38 is a schematic view showing bulkiness and characteristics of a bundle of superfine filaments (at the time of free crimping) according to the present invention.

By contrast, in the present invention, with the differential coefficients contraction, as shown in FIG. 38, a superfine crimped filament component overlaps with another superfine straight filament component, which is exactly the same result illustrated in FIG. 2(*b*). This is true even if each crimp does not make a complete loop, though the effect of the crimp in that case may be less.

In accordance with the present invention, compared with the case where all filaments reveal crimp, a very peculiar filament is produced having a voluminous feel, which is unexpected. This may be used to bloom naps of raised fabrics. Accordingly, compared with the crimp produced in a bundle of superfine crimped filaments as shown in FIG. 37, which has heretofore been considered most excellent, a bundle of superfine crimped filaments of a superior structure may be obtained according to the present invention. In addition, such filaments may have no crimp while being processed into a woven fabric, knitted fabric or non-woven fabric, and are less bulky and easy to process. After a sheet-like fabric has been formed, said filaments may be rendered superfine by mechanical or chemical actions and said filaments may be treated to produce crimp by further heat-treatment or chemical treatment. According, in regard to the present invention, it should be noted that it is not necessary that a mixture consisting of a superfine crimpable component and a superfine non-crimpable component or a superfine contractible component and a superfine non-contractible component be made first, and then that such mixture be processed into filaments. Rather, superfine filaments having such potential are readily processed in a fasciated state, namely, in an easily processable condition like the filaments of an ordinary yarn. Thereafter the respective components are separated and made independent from such fasciated component, to produce particular effects of this invention.

As mentioned above, composite filaments used in the present invention are roughly divided into three types, the characteristics of each of which will be mentioned hereinafter.

In the first type, namely, in the case of each of the composite filaments shown in FIGS. 3–10, the contraction force is relatively strong, even in a restrained state, for example. As formed into a fabric, the product may become comparatively bulky.

In other words, with regard to the difference in coefficient of contraction of the component fibers, the loss of crimpability due to making the composite filament superfine is small. In addition, compared to ordinary filaments such superfine multifilaments, according to the present invention, are mixed without being maldistributed. There is good in affinity between the component filaments, and the composite multifilament shows a good tendency to become puffy.

In the second type, namely, in composite filaments such as those shown in FIGS. 11–26; a mechanical peeling method is applied and the chemical aid of a solvent is not necessary, accordingly there is no reduction of contractibility due to the action of the solvent; therefore, when a method of thermal contraction is adopted between two components A and B, crimp is very likely to be brought about. However, in this type of filament, peeling has to be carried out mechanically, and even when component C is unnecessary, for example, from the point of view of dyeing fastness, it may nevertheless be allowed to remain present. However, such filaments may peel at a stage where peeling is not wanted and this may be a drawback in that such a filament may have comparatively poor processability. On the other hand, there is, of course, no loss of components. These points become merits or demerits, depending upon the object at hand.

In the third type of filament in accordance with the present invention, as illustrated by FIGS. 27–36 of the drawings, removal of one component is normally carried out by dissolution. Owing to the use of a chemical solvent crimpability due to difference of contraction between the two island components A and B is often inferior. The contraction power of one component is reduced by a crystallization phenomenon caused by the solvent of component C, which is called solvent crystallization. When heating is effected at the time of dissolution, loss of crimpability is even more likely. There are also other necessary drawbacks in removing one component by dissolution, including the loss of the component in solution. However, as an advantage, the removal of the dissolved component creates spaces providing room among the superfine filaments, which contributes to a considerable feel-improving effect, which cannot be overlooked. In other words, this type of filament and procedure also has its merits and demerits.

Composite filaments of the third type having an "islands-in-sea" type cross-sectional configuration, as shown in FIGS. 27–36, are especially important because in an "islands-in-sea" type filament, filaments are well fasciated. Such a filament has good processability because of the high degree of filament concentration in the non-bulked state. This cannot be overlooked. It is another characteristic that a treatment spaces among filaments by removal of component C brings about an effect similar to that of removing sericin from silk consisting of sericin and fibroin by degumming. It is still another characteristic of filaments of the third type that it is possible to select components of the same kind such as, for example, polyesters having different contractibility and to make it possible to mix different kinds of components, such a polyamide and polyethylene.

In the foregoing description, the merits and demerits of the respective embodiments of this invention have been mentioned so that different forms of the invention may be properly used in accordance with the user's intended objects. What may be said about them in common is that, as shown in FIG. 38, a bundle is so made that a component (or a plurality of such components) treatable to form a superfine crimp is interposed among other components which, under the same treatment, do not form a superfine crimp. Therefore, effects in bulkiness, mutual dispersion among filaments and improvement in feel are brought about, depending on the selection of filament type and composition.

These composite filaments may be used for production of various kinds of fiber products such a woven fabrics, knitted fabrics and non-woven fabrics. Examples of woven fabrics include crepe, such as crepe de Chine, palace crepe, satin crepe, morocain crepe, striped crepe, oriental crepe, flat crepe, georgette crepe and silk crepe, or various kinds of crepe weaves, such as amundsen jersey. Other examples include habutae (glossy) silk, satins, silk gauzes, voiles, porous fabrics, twille weave, serges, taffetas, cord weaves, velvets, towel weaves, flannels, shirting and various other designs of weave. Above all, these filaments are preferably used for producing raised fabrics such as velvet, velveteen and corduroy and further fabrics of a type which is raised by use of a raising machine.

As to knitted fabrics, besides various conventional knitted fabrics, other knits, such as platen or tricot fabrics or two-ply fabrics, of which especially those which are raised or napped may be cited, may also be made from filaments of the present invention.

Among non-woven fabrics, one should include needle punched non-woven fabrics, non-woven fabrics made by the paper making types of methods, and also spun bond non-woven fabrics. From such woven, knitted or non-woven fabrics it is possible to make raised fabrics having good nap dispersibility by subjecting them to napping and/or buffing. It is also possible to make a raised fabric such as velveteen or velvet by cutting to make them into piled fabrics. In each of these instances, the surprisingly advantagesous effects of the present invention are effectively revealed.

It is especially preferable that the deniers of filaments after being made superfine should be about 0.05–0.6 in the case of rased fabrics and about 0.6–2.0 in the case of non raised fabrics. It is preferable that the denier of the composite filament before being made superfine should be within the range of about 15-1 denier. In the case of mixed denier, it is preferable that the difference of deviation of the various deniers of the filaments after being made superfine should not exceed about 1.0 denier. As regards treating the filaments for the purpose of imparting crimp thereto, heating is especially preferable.

The most preferable combination of the component A and B is a combination of polyesters, particularly a combinstion of polyethylene terephthalate with the product obtained by copolymerizing isophthalic acid or sodium sulfonate isophthalate with the same, with the products obtained by copolymerizing a small amount of a trifunctional component with the same, or with polybuthylene terephthalate or other known polyesters with the same.

The amounts, components and draw conditions are so determined bring about a difference in coefficient of contraction. Also, various polyamides, namely, nylon 6, nylon 66, PACM- , IPA- and TPA-copolymerized nylon 66 and various other copolymers are preferable as the components A and B. It is a matter of course that combinations of polymers of different series are acceptable.

As the component C, there may be cited polymers of the polystyrene series, polymers of the polyvinyl series, copolyesters, polymers of the polyamide series and a polymers of the polyolefin series. The component C may be properly used by dissolving and removing the same or by peeling the same.

It goes without saying that for use as the components A, B and C, all the known fiber-forming polymers are applicable as well as those mentioned above.

When the remaining component is polyester, it is especially preferable for producing a silky feel to treat polyester with an alkali solution. An original yarn may be also textured-processed, such as by false weave processing and made into a yarn having strong twist. For example, a combination with strong twist SZ is possible.

It is a matter of course that when the two components A and B are different in dyeability, it is possible to dye them differently, and it is possible to subject them to resin processing and to process them by adding a feel-improving agent such as polyurethane and silicone. When, for example, such filaments are needle punched, processed with polyurethane before the component C is removed and thereafter buffed, it is possible to make a fabric consisting of said filaments into suede-like artificial leather and to produce a product having excellent feel by so doing.

EXAMPLE 1

A three-component "islands-in-sea" type composite filament having a cross sectional area as shown in FIG. 4 was produced by using polyethylene terephthalate as one island component and a copolyethylene terephthalate containing 9.9 mol % of an isophthalic acid component as the other island component. Specifically, by using a spinneret (for 42 filaments) for a composite filament which consisted of a number of cores embedded in the matrix, said cores being extremely fine and parallel to each other along the fiber axis as shown in Japanese Patent Application Publication No. 26723/1972, the aforementioned composite filament was first spun in the usual way at 280° C., then wound, and finally drawn with heating to obtain a 3.8 denier yarn. The number of island components so obtained was equal to sixteen, eight of which consisted of polyethylene terephthalate and eight of which consisted of copolyethylene terephthalate; all such island components accounted for 60% of the yarn.

This filamentary yarn was washed well with carbon tetrachloride and dried to obtain a bundle of superfine filaments. At this point the bundle thus obtained was free from swelling; however, when the bundle was immersed in boiling water, filaments consisting of said copolyester having copolymerized isophthalic acid contracted greatly. As a result, a remarkable swelling was seen in the bundle of superfine filaments. The difference in coefficient of contraction between the highly contractible component and the slightly contractible component was not less than 5%. It is notable that the component having the higher coefficient of contraction appeared to have been drawn to the inside of the fiber.

EXAMPLE 2

A drawn composite filament having a cross sectional area as shown in FIG. 3 was produced, wherein the two kinds of the island components were the same as in Example 1, but the sea component thereof was polystyrene which had 22% by weight of copolymerized 2-ethylhexyl acrylate, the island/sea ratio being 85/15.

Using a yarn consisting of such filament both as warp and weft, the following plain fabric was woven. Specifically, in weaving the plain fabric for the warp, a total 50 denier of about 5.6 d/9 fil yarn was used, at a plain fabric density of 110 warps/in; for the weft, a total 73 denier of about 5.6 d/13 fil yarn was used at a plain fabric density of 83 wefts/in. Two such woven fabrics were prepared; one fabric was washed with carbon tetrachloride while the other fabric was washed with trichloroethylene. Each was dried and then immersed in boiling water. Both such treatments cause fabric swelling, but the swelling of the fabric washed with the carbon tetrachloride was superior to the swelling of the fabric washed with trichloroethylene. Said fabric was subsequently washed in a hot 2.5 g/liter aqueous bath of sodium hydroxide, the surface thereof finally treated with an alkali, washed with water, dried and finally passed through air at 180° C. for a short period of time. The product thus obtained was a pliant woven fabric having a silk-like luster and feel.

EXAMPLE 3

A composite filament was produced which consisted of many cores embedded within the matrix, said cores being extremely fine parallel to each other along the fiber axis. The composite filament further had an "islands-in-sea" type cross sectional configuration with thirty six islands, of which half were polyethylene terephthalate and half were copolyethylene terephthalate containing 9.9 mol % of an isophthalic acid component as in Example 1; the sea component was polystyrene, and island/sea ratio was 95/5. The thus obtained drawn yarn consisting of total denier 100 d/25 filaments was used as the pile yarn when weaving velvet-like fabrics. As both warp and weft of the base texture, a 50 D-36 f bulky processed yarn having a T-shaped cross sectional configuration (process for producing the same being disclosed in Japanese Patent Application Publications Nos. 18535/1976 and 47550/1972) was used and the length of the raising was made to equal 1.0 mm. Two such fabrics were prepared, each of which was washed with a sufficient amount of an alkali; then with a sufficient amount of water. Thereafter, one fabric was washed with carbon tetrachloride and the other fabric was washed with trichloroethylene. It is necessary to sufficiently wash the fabric with water after the alkali treatment, but prior to the trichloroethylene washing in order to prevent the production of explosive dichloroacetylene.

Next, when the two fabrics were exposed in hot air at 180° C. and thereafter dyed in blue, very elegant raised fabrics (which might be well called velvets having suede effects) having different pile (raising) lengths were obtained.

EXAMPLE 4

Figure 27:
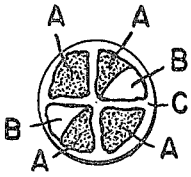
Figure 28:
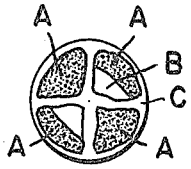

A three-component composite filament having an "islands-in-sea" type cross sectional configuration as shown in FIG. 27 (number of islands: 4) was made. Namely, as component A, polyethylene terephthalate was used, and as component B, copolyethylene terephthalate having copolymerized 10 mol % of isophthalic acid was used. The ratio of A/B was made 75/25. As component C, polystyrene was used. The ratio of component C to the entirety was made 20%. The composite filament having a cross sectional configuration was spun by a three-component filament spinning machine and drawn to 3.3 times. The obtained yarn was about 4 denier/12 fil. A skein consisting of a plurality of such yarns was made and thereafter, the component C consisting of polystyrene was dissolved with carbon tetrachloride and removed. Thereafter, when crimp was imparted by the treatment of boiling water, the skein became very bulky. When this skein was grabbed by hand, the bulkiness was high and a remarkable difference was recognized compared with the following comparative example.

COMPARATIVE EXAMPLE 1

A composite filament having an "island-in-sea" type cross sectional configuration similar to that of FIG. 27 was produced, wherein the entire island components were polyethylene terephthalate only and the component C (sea component) was polystyrene. The denier and island/sea ratio were so adjusted as to become the same as in Example 1. Similarly, component C was dissolved with carbon tetrachloride and removed and thereafter what was obtained was treated in boiling water and dried.

On the other hand, using a composite filament whose cross sectional configuration was similar to that of FIG. 27, with the exception that all the island components had an A/B bimetal type composite structure, a skein was made by the same manner as in Example 4.

When the so obtained two samples were compared (after drying) with the product of the present invention obtained in Example 1, the product of the present invention was superior in bulkiness. Bulkiness was measured by strongly grabbing the skein many times by hand, and the state of each skein was checked after the hand had been removed. The skein of composite filaments wherein all the "island" components thereof were the same was lowest in bulkiness, followed by the skein of composite filaments wherein all components comprised a bimetal-type structure. The product of the present invention was the best in bulkiness properties. This skein (present invention) comprised an aggregate of bundles of superfine filaments having a different hand when compared to the other two skeins.

EXAMPLE 5

Using the same filament yarn as in Example 4, a plain fabric was woven. Its density was 115 warps/in and 83 wefts/in. This fabric was dissolved with carbon tetrachloride, thereafter, its surface was washed with hot alkali diluted with water, to slightly dissolve the surface. Then, it was washed with water and dried. Crimp was imparted to an extent sufficient to separate one filament from another inside the organization. A silk-like feel was evident on the fabric surface and said plain fabric exhibited very excellent, silk-like qualities.

EXAMPLE 6

Example 5 was repeated except polybutylene terephthalate was used instead of a copolyethylene terephthalate having copolymerized isophthalic acid as component B. Also trichloroethylene was used as a solvent in treating the plain fabric. The resulting fabric was somewhat different in hand from the woven fabric obtained in accordance with Example 5. The repulsion and bulkiness of this fabric also differed from the fabric produced in Example 5. However, this fabric also exhibited excellent woven silk-like qualities.

EXAMPLE 7

Figure 29:
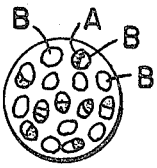
Figure 30:
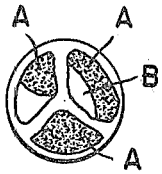
Figure 31:
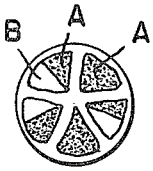
Figure 32:
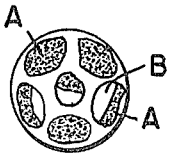
Figure 33:
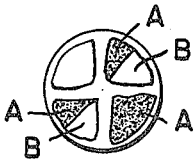
Figure 34:
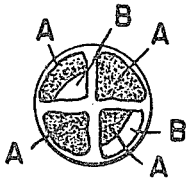
Figure 35:
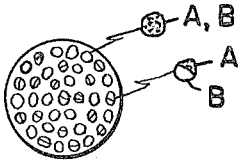
Figure 36:
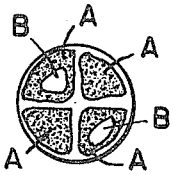

A composite filament having an "island-in-sea" type cross sectional configuration of the type shown in FIG. 29 was produced. The total number of islands was sixteen and island component A comprised a copolyester containing polyethylene terephthalate and 9.9 mol % of isophthalic acid. The island component B comprised polyethylene terephthalate. The ratio was (A/B=12/4), and the sea component was a styrene-octyl acrylate (78/22) copolymer present in an amount equal to 4% of the entire composite filament. The filament was spun as a composite filament consisting of many cores embedded with the matrix. Said cores were extremely fine, drawn and parallel to each other along the fiber axis. The total denier and number of filaments in the yarn produced therefrom were 104 D-42 f. Using the obtained yarn as the "nap" warp, a 50 D-18 f united filament (100 D) as texture warp and as texture weft, a 2-ply velvet weave was produced. The length of the raising (naps) in the fabric was about 0.9 mm and the fabric density was 60 warps/in and 90 wefts/in. This woven fabric was washed with trichloroethylene in a washing machine and dried. Thereafter, said woven fabric was treated in boiling water under relaxed conditions and heatset at 170° C. for 5 minutes. Thereafter, it was dyed black in a liquid stream circular dyeing machine at 120° C. under pressure. The resulting fabric had naps which could be well bloomed and there were intervals among the naps. Also, light fuzz was mixed in the naps and the overall hand of the fabric was that of a very soft raised woven fabric. On the other hand, a fabric produced according to this example (with the exception of using a composite filament whose islands all comprised component A) is obviously different in appearance and luster compared to the fabric of this example.

What is claimed is:

1. An "islands-in-sea" type multi-component composite filament, for preparing a bundle of puffy superfine filaments upon separation from said sea component and upon differential contraction comprising at least three components including at least two different kinds of filamentary island components each dispersed independently in said sea component, one such component being a single component, interposing therebetween without maldistribution of such filamentary components to either side of said sea component as viewed in said cross-sectional configuration, said composite filament being further characterized by having a difference in coefficient of free contraction between the respective kinds of filamentary island components of at least 5%, and the sum of the weights of said island components being greater than the weight of said sea component.

2. An "islands-in-sea" type multicomponent composite filament for preparing puffy superfine filaments upon separation from said sea component and upon differential contraction, said filament having filamentary island components and a component interposed therebetween, said filament comprising at least three polymer components, said filament comprising a sea component and at least two different kinds of filamentary island components having different contracting or crimping properties, each of said island components being dispersed independently without maldistribution to any one side of said sea components as viewed in said cross-sectional configuration, characterized in that one of said filamentary island components comprises a single component filament and the other of said island components comprises a bi-component type filament wherein the sum of the weights of said filamentary island components is greater than the weight of said sea component, said composite filament being further characterized by having a difference in coefficient of free contraction between the respective kinds of filamentary island components of at least 5%.

3. A multi-component composite filament according to claim 1 or 2, wherein the denier of said island components is between about 0.05–0.6 d.

4. A multi-component composite filament according to claim 1 or 2, wherein the denier of said island components is between about 0.6–2.0 d.

5. A multi-component composite filament according to claim 1 or 2, wherein the denier of said filament is between about 1–15 d.

6. A multi-component composite filament according to claim 1 or 2, wherein each of said island components is dispersed in a mutually interposed pattern.

7. A multi-component composite filament according to claim 1 or 2, wherein said island components are disposed concentrically.

8. A multi-component composite filament according to claim 1 or 2, wherein said island components are exposed on the surface of said composite filament.

9. A multi-component composite filament according to claim 1 or 2, wherein said island components are islands covered by said matrix component.

10. A multi-component composite filament according to claim 1 or 2, wherein said island components are polymers of the polyester series.

* * * * *

UNITED STATES PATENT AND TRADEMARK OFFICE

CERTIFICATE OF CORRECTION

PATENT NO. : 4,381,335

DATED : 4/26/83

INVENTOR(S) : Miyoshi Okamoto

It is certified that error appears in the above—identified patent and that said Letters Patent is hereby corrected as shown below:

Column 3, line 46, delete "eans" and insert --means--.

Column 3, line 51, after "difference" insert --between--.

Column 4, line 67, after "the" (second occurrence) insert --use of--.

Column 6, line 29, after "treatment" insert --which forms--.

Column 7, line 35, after "determined" insert --as to--.

Column 7, line 45, delete "a".

Signed and Sealed this

*Thirteenth* Day of *March 1984*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,381,335

DATED : 4/26/83

INVENTOR(S) : Miyoshi Okamoto

It is certified that error appears in the above-identified patent and that said Letters Patent is hereby corrected as shown below:

Column 12, line 36, et seq, please insert

--11. An "island-in-sea" type multicomponent composite filament for preparing puffy superfine filaments upon separation from said sea component and upon differential contraction, said filament having filamentary island components and a component interposed therebetween, said filament comprising at least three polymer components, said filament comprising a sea component and at least two different kinds of filamentary island components having different contracting or crimping properties, each of said island components being dispersed independently without maldistribution to any one side of said sea components as viewed in said cross-sectional configuration, characterized in that one of said filamentary island components comprises a single component filament and the other of said island components comprises an eccentrically arranged composite filament, wherein the sum of the weights of said filamentary island components is greater than the

UNITED STATES PATENT AND TRADEMARK OFFICE

CERTIFICATE OF CORRECTION

PATENT NO. : 4,381,335

DATED : 4/26/83

INVENTOR(S) : Miyoshi Okamoto

It is certified that error appears in the above-identified patent and that said Letters Patent is hereby corrected as shown below:

weight of said sea component.--

On the title page "10 Claims" should read -- 11 Claims --

Signed and Sealed this

*Twenty-second* Day of *May 1984*

[SEAL]

*Attest:*

GERALD J. MOSSINGHOFF

*Attesting Officer*

*Commissioner of Patents and Trademarks*

UNITED STATES PATENT AND TRADEMARK OFFICE

CERTIFICATE OF CORRECTION

PATENT NO. : 4,381,335

DATED : April 26, 1983

INVENTOR(S) : Miyoshi Okamoto

It is certified that error appears in the above-identified patent and that said Letters Patent is hereby corrected as shown below:

Column 12, line 36, et seq, please insert

--11. An "island-in-sea" type multicomponent composite filament for preparing puffy superfine filaments upon separation from said sea component and upon differential contraction, said filament having filamentary island components and a component interposed therebetween, said filament comprising at least three polymer components, said filament comprising a sea component and at least two diffenent kinds of filamentary island components having different contracting or crimping independently without maldistribution to any one side of said sea components as viewed in said cross-sectional configuration, characterized in that one of said filamentary island components comprises a single component filament and the other of said island components comprises an eccentrically of said filamentary island components is greater than the weight of said sea component, said composite filament being further characterized by having a difference in coefficient of free contraction between the respecrive kinds of filamentary island components of at least 5%.--

UNITED STATES PATENT AND TRADEMARK OFFICE

CERTIFICATE OF CORRECTION

PATENT NO. : 4,381,335

DATED : April 26, 1983

INVENTOR(S) : Miyoshi Okamoto

It is certified that error appears in the above-identified patent and that said Letters Patent is hereby corrected as shown below:

On the title page "10 Claims" should read -- 11 Claims --.

This certificate supersedes Certificate of Correction issued May 22, 1984.

Signed and Sealed this

*Twenty-fifth* Day of *June 1985*

[SEAL]

*Attest:*

DONALD J. QUIGG

*Attesting Officer* *Acting Commissioner of Patents and Trademarks*

Disclaimer 4,381,335.—*Miyoshi Okamoto*, Osaka, Japan. MULTI-COMPONENT COMPOSITE FILAMENT. Patent dated Apr. 26, 1983. Disclaimer filed Sept. 12, 1986, by the assignee, *Toray Industries, Inc.*.

Hereby enters this disclaimer to claims 2 and 11 of said patent.

[*Official Gazette February 17, 1987.*]